US005797274A

United States Patent [19]

Jackaman et al.

[11] Patent Number: 5,797,274

[45] Date of Patent: Aug. 25, 1998

[54] COOLING OF HOT BODIES

[75] Inventors: David Peter Jackaman; William Barry Featherstone, both of Cleveland, England

[73] Assignee: Davy McKee (Stockton) Limited, England

[21] Appl. No.: 632,485

[22] PCT Filed: Oct. 28, 1994

[86] PCT No.: PCT/GB94/02369

§ 371 Date: Apr. 19, 1996

§ 102(e) Date: Apr. 19, 1996

[87] PCT Pub. No.: WO95/12797

PCT Pub. Date: May 11, 1995

[30] Foreign Application Priority Data

Nov. 3, 1993 [GB] United Kingdom ..... 9322696

[51] Int. Cl.[6] ..... F28D 3/00

[52] U.S. Cl. ..... 62/171; 62/304; 62/506; 236/44 B; 239/75

[58] Field of Search ..... 62/304, 305, 306, 62/310, 171, 121, 506; 261/116, 78.2; 164/486; 236/44 B; 239/75; 373/74, 76

[56] References Cited

U.S. PATENT DOCUMENTS 3,817,053 6/1974 Orth ..... 62/210
4,552,303 11/1985 Fisher et al. ..... 236/44 C

FOREIGN PATENT DOCUMENTS 0 044 512 7/1981 European Pat. Off. .

*Primary Examiner*—John M. Sollecito
*Attorney, Agent, or Firm*—Lee, Mann, Smith, McWilliams, Sweeney & Ohlson

[57] ABSTRACT

An apparatus for cooling a vessel containing molten metal has a quantity of liquid coolant atomized by a gaseous medium and onto a surface to be cooled. The supply of gaseous medium is constant while the supply of liquid coolant to the spray nozzles is controlled by at least one valve the operation of which is brought about by a non-electrical temperature responsive element in thermal contact with the surface to be cooled. The rate at which the liquid coolant is sprayed on to the hot surface is controlled such that the volume of coolant sprayed on to the surface to be cooled does not exceed the volume of liquid that is capable of being vaporized from the surface.

9 Claims, 2 Drawing Sheets

COOLING OF HOT BODIES

Figure 1:
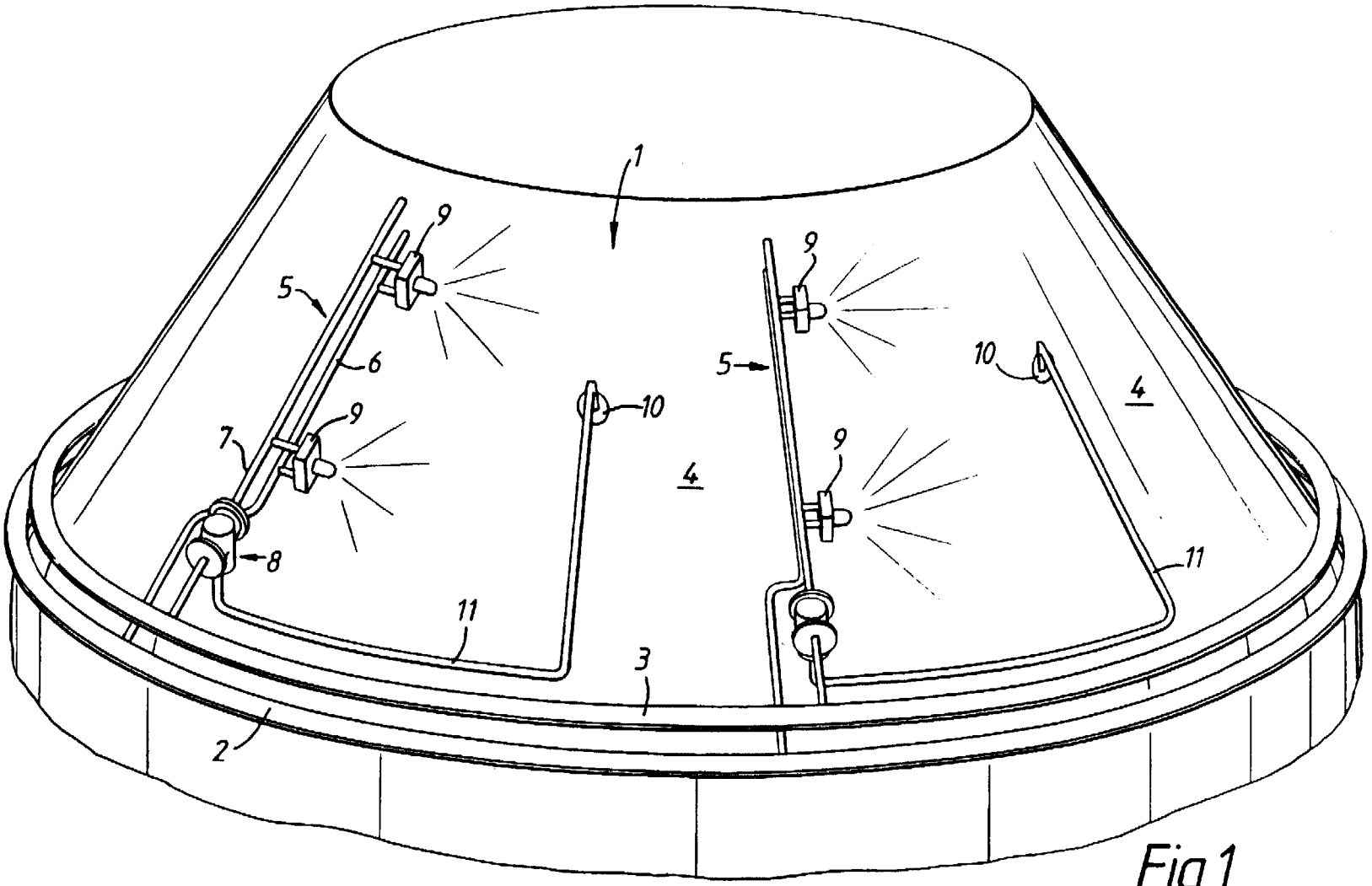

This invention relates to a method of cooling a hot body and to a body which, in use, has to be cooled with liquid coolant. A particular, but not sole, application of the invention is to a method of cooling a part of a vessel containing molten metal and to such vessels.

In pyrometallurgical processes, heat is generated during the smelting, melting or refining of the metal. The process ingredients are usually refined within a steel vessel which is lined with refractory material in order to protect the steel shell, as far as possible, from the high temperatures used in the process. Nevertheless, the shell usually becomes hot so it is beneficial to provide cooling of at least part of the shell in order that distortion is reduced and the shell material retains sufficient of its strength to operate according to the Designer's intentions.

It is now well recognised in the metallurgical industry that it is extremely dangerous to allow liquid water and liquid metal to come into close proximity to one another because, in the event of a fault occurring, the sudden expansion and vaporisation of water in contact with liquid metal can cause a dangerous explosion.

It is known from WO 89/03011 to cool a hot metal body forming part of a vessel containing molten metal by applying droplets of liquid coolant to the outer surface of the body in a controlled manner such that the volume of coolant applied in a given time period does not exceed the volume of coolant which is vaporised by contact with the hot surface in the given time period. In this document, it is disclosed that, in order to control the amount of liquid coolant applied to the outer surface of the body, one or more thermocouples are used to determine the temperature of the surface and this information is transmitted to a temperature controller remote from the body. This controller controls the supply of liquid coolant passing through one or more valves, also away from the body, to one or more sprays located adjacent to the body.

It is also known from EP-0044512-A to cool a vessel with a cooling box fitted into the wall of the vessel and the box contains a heat exchange surface onto which a cooling liquid is sprayed. The quantity of liquid sprayed onto the surface is controlled by a temperature measuring device so that a spontaneous evaporation of the cooling liquid occurs.

It will be appreciated from this description of the prior art that the provision of thermocouples on the surface to be cooled and one or more valves and a controller remote from the surface inevitably means that there are long electrical connections and coolant lines between the surface and the remote position where the valves and the controller are located.

An object of the present invention is to provide an improved method of controlling the surface temperature. The result is usually a reduction in capital cost and more sensitive control of surface temperature.

According to a first aspect of the present invention, in a method of cooling a hot body, a quantity of liquid coolant is sprayed onto a surface of the body to be cooled by one or more spray nozzles, and the volume of liquid coolant applied in a given time period is controlled so that it does not exceed the volume of liquid coolant which is vaporised by contact with the surface of the hot body in the given time period characterised in that a gaseous medium is supplied continuously to the or each spray nozzle and the liquid coolant which is atomised by the gaseous medium into droplets is supplied to the or each spray nozzle under the control of at least one valve the operation of which is brought about by the action of a non-electrical temperature responsive element in thermal contact with the surface.

It will be appreciated that, since the or each valve which controls the supply of liquid coolant to the or each spray nozzle is in turn controlled by a non-electrical temperature responsive element which is in thermal contact with the surface to be cooled, it will be clear that the valve is on, or very close to, the surface to be cooled and the element may be considered to be part of the valve. There are no electrical connections between sensors on the surface and either the valve or a controller at a position remote from the surface. The control of liquid coolant is determined entirely by the or each valve which is on, or very close to, the surface. The part of the element which is in thermal contact with the surface is conveniently a chamber embedded in the surface and which is connected to the valve by a capillary tube containing a fluid. An increase in temperature to the control temperature causes thermal expansion or an increase of the vapour pressure of the fluid in the element/capillary tube and opens the valve.

According to a second aspect of the present invention, a body, which in use has to be cooled with liquid coolant, said body having one or more spray nozzles arranged to receive liquid coolant and gaseous medium and to discharge droplets of atomised coolant onto a surface of the body, at least one valve which serves to control the supply of liquid coolant to the or each nozzle and which is operated under the action of a non-electrical temperature responsive element in thermal contact with the surface of the body so that the volume of coolant applied in a given time period does not exceed the volume of liquid coolant which is vaporised by contact with the surface of the hot body in the given time period.

A single valve may control the supply of liquid coolant to a single nozzle, to a single spray bar upon which two or more nozzles may be mounted, or to a group of spray bars. Conveniently, each valve is mounted on a branch pipe connected to a ring main through which the coolant circulates. The pressure within the ring main is controlled within limits so that, if any valve on the vessel is open to supply coolant to the or each spray nozzle to cool the relevant part of the vessel, make-up coolant is supplied in a controlled manner to the ring main.

In use, the temperature of the surface to be cooled is sensed by the elements. As the surface temperature rises, eventually the valve opens and allows coolant to flow to the or each spray nozzle. Air is continuously supplied to the or each nozzle so, as soon as liquid is supplied to the nozzle, atomisation of the coolant is achieved at low pressure and efficient evaporative cooling results in the region where the atomised coolant is deposited. As a result of the droplets of atomised coolant being deposited on the surface, the surface and element in contact with the surface cool and eventually the valve is closed. The system may be tuned to operate over a required temperature range, typically between 300° C. and 250° C. though, with advantage, between, for example, 250° C. and 200° C. when small surface areas may be treated independently.

In many applications, the vessel temperature is far from uniform. For example, in steel making, a vessel containing molten metal may be tilted less to a charging side than to a tapping side. This results in a build up of slag on the charging side while the vessel lining on the tapping side wears away. Consequently, the vessel shell on the tapping side tends to be hotter than on the charging side. In order to satisfy these diverse cooling requirements, each region of the vessel requires its own cooling system under its own independent control.

The present invention provides an arrangement by which a simple control system may be used, for example, for the whole of the top cone region of the vessel while allowing for different cooling requirements around the circumference of the vessel.

It is convenient for the gaseous medium, conveniently air, to be continuously supplied to the spray nozzles so that, when no cooling is required, dust is excluded from the nozzles. It is also convenient for the thermostatic valves to be constructed so that when no cooling is required, the valves and the spray nozzles are purged of coolant, usually water, and this reduces the possibility of evaporation of coolant in the spray bars and nozzles which would result in the deposition of dissolved solids inside them.

Figure 2:
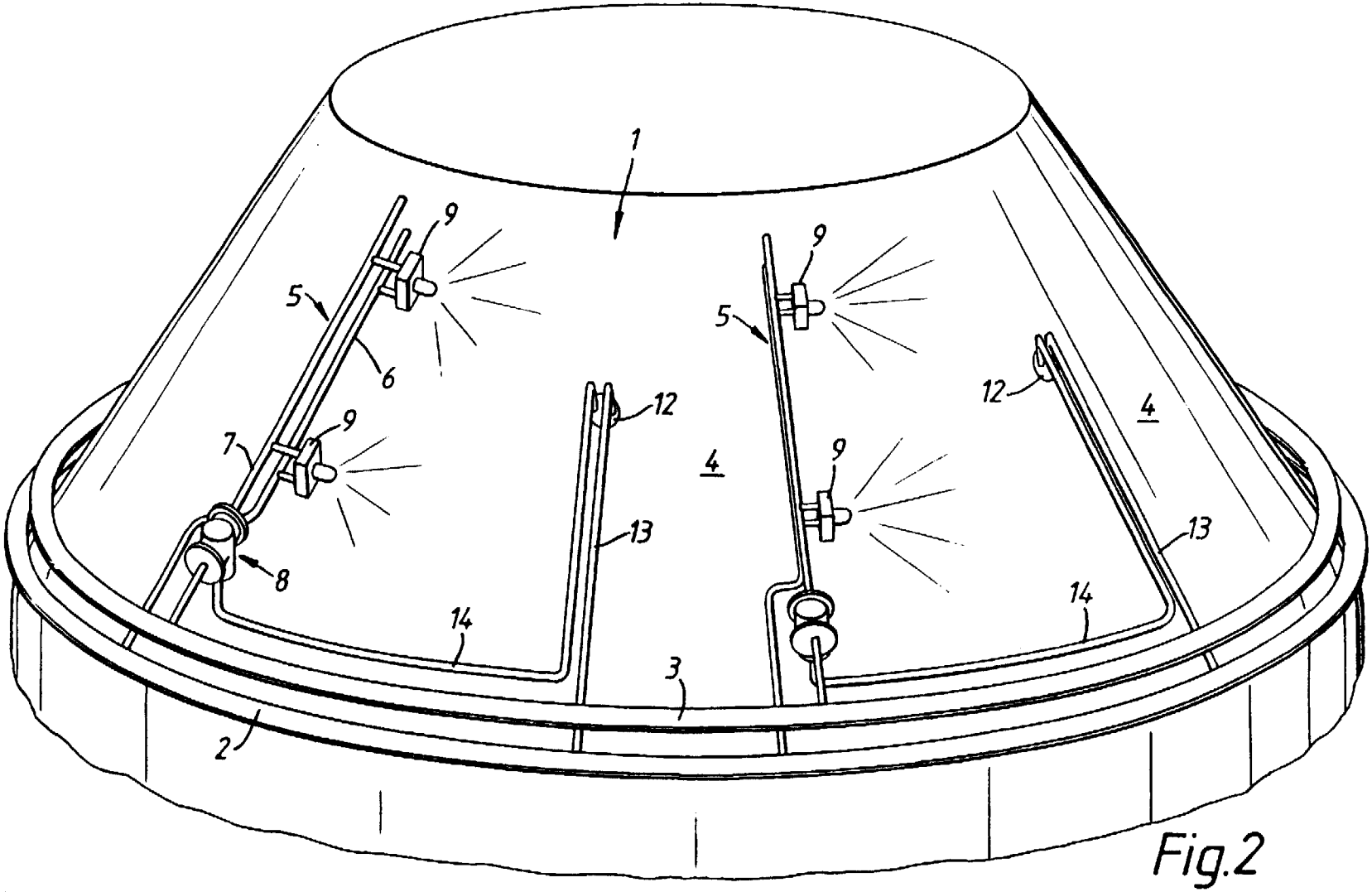

In order that the invention may be more readily understood it will now be described, by way of example only, with reference to the accompanying drawings in which FIGS. 1 and 2 are diagrammatic perspective views of a part of a steel making vessel illustrating alternative embodiments of the invention.

The cone defining the open top of a furnace vessel is indicated by reference numeral 1. Extending around the outer surface of the cone is a main pipe 2 having connections (not shown) by which air under pressure is supplied to the pipe. Similarly, a main pipe 3 extends around the cone and connections (not shown) supply coolant liquid, usually water, to the pipe.

The outer surface of the cone is divided into regions 4 by spray structures 5 which are located in spaced apart relation around the surface of the cone. Each structure comprises an air pipe 6 and a water pipe 7. The air pipe is connected at one end to the air main pipe 2 and is closed at the other end. The water pipe 7 is connected at one end to a valve 8 and the other end is closed. The valve is connected to the main pipe 3. A plurality of air-mist nozzles 9 are connected to the pipes 6 and 7. The surface of each region 4 has a non-electrical temperature responsive element in thermal contact therewith. In the arrangement shown in FIG. 1 each element 10 comprises a bulb in a pocket formed in the surface and the bulb is connected to the valve 8 by a capillary tube 11. A fluid is present in the bulb and the capillary tube. The valve 8 is operable by changes in pressure applied to it by the fluid in the bulb and capillary tube.

In the FIG. 1 arrangement, in use, air under pressure is supplied to the pipe 2 and by way of the pipes 6 to the nozzles 9. Water is supplied under pressure to the pipe 3 and hence to the valves 8. The valves are normally closed so that the water is not supplied to the nozzles 9. The surface temperature of each region 4 is transmitted from the sensor part of the element in contact with the surface to the valve and at the appropriate temperature the expansion or pressure of the fluid in the capillary tube 11 opens the valve 8 to allow water to flow to the pipe 7 and hence to the nozzles 9 where a fine mist is directed over the region 4 of the surface. As the surface and sensor cool, the expansion or pressure of the fluid in the sensor/capillary tube falls and eventually the valve closes cutting off the water supply to the corresponding nozzles.

In the alternative arrangement shown in FIG. 2, the temperature responsive element 12 is an open/shut valve which is thermostatically controlled. Air from the main pipe 2 is supplied to the input of the element 12 by a small bore tube 13 and the outlet of the element is connected to the valve 8 by another small bore tube 14. The element 12 may be operated by bi-metallic expansion or by expansion of a fluid contained in a chamber in the element. As the surface reaches the design temperature, element 12 opens, allowing air to pass through the tubes 13 and 14 to operate the valve 8. Similarly when the temperature drops, the element 12 closes and tube 14 is vented to atmosphere allowing valve 8 to close. Alternatively, the element 12 may open and close at the upper design temperature. As the temperature increases through say 300° C. the element 12 opens. This allows valve 8 to operate. As the temperature falls through 300° C. element 12 closes and isolates the air volume in tube 14 keeping the valve 8 open. At the lower design temperature, say 200° C., a small vent within the element 12 opens, releasing the pressure of the air in the tube 14 thereby allowing the valve 8 to close.

It will be appreciated that by supplying the appropriate number of spray structures 5 each controlling a separate region, the size of each region can be reduced to produce an accurate control of the temperature of the region. Furthermore, some regions may be deliberately arranged to operate at different temperatures.

We claim:

1. A method of cooling a hot metal body which forms part of a vessel containing molten metal, comprising the steps of disposing a plurality of spray nozzles in relation to a surface of the body to be cooled; arranging a non-electrical temperature responsive element in thermal contact with the surface of the body to be cooled; supplying gaseous medium continuously to the nozzles; supplying liquid coolant to the nozzles under the control of at least one valve operated by the action of said temperature responsive element for the liquid coolant to be atomised into droplets by the gaseous medium and the droplets to be sprayed onto the surface of the body and said valve being controlled such that the volume of liquid coolant applied to the surface in a given time period does not exceed the volume of liquid coolant which is vaporised by contact with the surface of the hot metal body in the given time period.

2. A method as claimed in claim 1 in which the surface of the body to be cooled is considered to be divided into regions each of which receives liquid coolant from one or more spray nozzles, and the liquid coolant is supplied to said one or more spray nozzles under the control of at least one valve the operation of which is brought about by the action of a non-electrical temperature responsive element in thermal contact with said region of the surface.

3. A method as claimed in claim 1 in which at least one temperature responsive element includes a fluid and the operation of its associated valve is brought about by changes in the vapour pressure of the fluid.

4. A method as claimed in claim 1 in which at least one valve is operated in response to the supply of a gaseous medium thereto, said supply of said gaseous medium being controlled by said temperature responsive element.

5. A metal body which is to be cooled and which forms part of a vessel containing molten metal, a plurality of spray nozzles disposed in relation to a surface of the body to be cooled; a non-electrical temperature responsive element arranged in thermal contact with the surface of the body to be cooled; a gaseous medium connected to be supplied continuously to the nozzles; means for supplying liquid coolant to the nozzles under the control of at least one valve operated by the action of said temperature responsive element for the liquid coolant to be atomised into droplets by the gaseous medium and the droplets to be sprayed onto the surface of the body and means for controlling said valve such that the volume of liquid coolant applied to the surface in a given time period does not exceed the volume of liquid coolant which is vaporised by contact with the surface of the metal body in the given time period.

6. A vessel as claimed in claim 5 in which there are a plurality of said spray nozzles arranged adjacent said surface so that the surface can be considered to be divided into regions each of which receives the droplets from one or more spray nozzles and the supply of liquid coolant to the or each spray nozzle supplying droplets to each region is controlled by a separate valve and a separate non-electrical temperature responsive element in thermal control with said region of the surface brings about the operation of said valve.

7. A body as claimed in claim 5 in which the at least one temperature responsive element is connected to its valve by a capillary tube containing a fluid and arranged such that operation of the valve is brought about by changes in the vapour pressure of the fluid.

8. A body as claimed in claim 5 in which the at least one or each element includes a bi-metal the operation of which controls the flow of an actuating gas to the valve with which it is associated.

9. A vessel as claimed in claim 5 in which the body is a cone defining the open top of a furnace vessel.

* * * * *